US007036671B2

(12) United States Patent
Hidalgo et al.

(10) Patent No.: US 7,036,671 B2
(45) Date of Patent: May 2, 2006

(54) CONTAINER HAVING DAMAGE-RESISTANT FINISH RING

(75) Inventors: Dennis K. Hidalgo, Brighton, CO (US); Terry D. Walker, Westminster, CO (US); Michael S. Reams, Evergreen, CO (US); Kevin L. Gobbo, Golden, CO (US)

(73) Assignee: Coors Global Properties, Inc., Lakewood, CO (US)

( * ) Notice: Subject to any disclaimer, the term of this patent is extended or adjusted under 35 U.S.C. 154(b) by 308 days.

(21) Appl. No.: 10/612,867

(22) Filed: Jul. 2, 2003

(65) Prior Publication Data

US 2004/0026352 A1 Feb. 12, 2004

Related U.S. Application Data

(60) Provisional application No. 60/397,521, filed on Jul. 22, 2002.

(51) Int. Cl.
*B65D 23/00* (2006.01)

(52) U.S. Cl. ..... 215/43; 215/40; 215/304

(58) Field of Classification Search ..... 215/40, 215/42, 43, 304

See application file for complete search history.

(56) References Cited

U.S. PATENT DOCUMENTS

| | | | | | |
|---|---|---|---|---|---|
| 1,923,091 | A | * | 8/1933 | Hoffman | 215/251 |
| 2,019,014 | A | * | 10/1935 | Kuhne | 215/257 |
| 2,421,356 | A | * | 5/1947 | Saffady | 215/274 |
| 2,734,650 | A | * | 2/1956 | Meyer | 215/246 |
| 2,992,574 | A | * | 7/1961 | Martinmaas | 81/3.15 |
| 3,247,994 | A | * | 4/1966 | Stocklund et al. | 215/321 |
| 3,250,418 | A | * | 5/1966 | Waters | 215/302 |
| 3,872,993 | A | * | 3/1975 | Aichinger et al. | 215/320 |
| 4,641,758 | A | * | 2/1987 | Sugiura | 215/42 |
| 4,674,644 | A | * | 6/1987 | Jacobs | 215/320 |
| 4,782,969 | A | * | 11/1988 | Henning | 215/295 |

* cited by examiner

*Primary Examiner*—Sue A. Weaver

(74) *Attorney, Agent, or Firm*—Klaas, Law, O'Meara & Malkin, P.C.; William P. O'Meara; Nellie C. Kaufman

(57) ABSTRACT

A container having a damage-resistant finish ring and an opening sealable by a closure member that is removable by a hook-type opener is disclosed. The damage-resistant finish ring has a locking ring with a convex outer surface.

4 Claims, 5 Drawing Sheets

CONTAINER HAVING DAMAGE-RESISTANT FINISH RING

REFERENCE TO CO-PENDING PROVISIONAL APPLICATION

The benefit of earlier-filed co-pending U.S. Provisional Patent Application Ser. No. 60/397,521 filed Jul. 22, 2002 for CONTAINER, which is hereby incorporated by reference for all that it discloses, is hereby claimed.

FIELD OF THE INVENTION

The present invention relates generally to containers having a finish ring surrounding an opening in the container, and, in particular, to a container having a finish ring that resists frictive damage when coming in contact with a hook-type opener.

BACKGROUND OF THE INVENTION

A container such as a glass beverage bottle may have a finish ring which is the uppermost portion of the bottle surrounding the opening in the container. The opening may be sealed with a closure member such as a cap that is crimped around and at least partially against the finish ring, thereby forming a "crown" at the top of the bottle. In order to be adequately sealed on a bottle, the closure member must be securely crimped around a locking ring which is generally at a lowermost portion of the finish ring. The crown may be removed with a hook-type opener having a hook portion that engages the crown at an edge thereof which is adjacent to the outer surface of the finish ring. When a hook-type opener is operated by a user, the hook portion may also engage or otherwise disrupt the outer surface of the finish ring at or near the locking ring, often resulting in frictive damage to the locking ring. Such frictive damage may be in the form of a chip breakage which may enter the container as the hook-type opener removes the crown.

SUMMARY OF THE INVENTION

The present invention is directed to a container having a damage-resistant finish ring. The container has an opening sealable by a closure member that is removable by a hook-type opener. There is a locking ring on the finish ring which has a convex outer surface having a radius and a height. The locking ring extends from a first circumferential edge to a second circumferential edge. The finish ring also has an upper convex outer surface portion directly adjacent to and above the locking ring and a concave outer surface portion directly adjacent to and below the locking ring. The locking ring has a relatively smooth outer surface, and the intersections of the locking ring and upper convex and concave outer surface portions are relatively smooth, such that a hook-type opener may pass by the locking ring unimpeded upon removal of the closure member by the hook-type opener. The radius of the locking ring is sufficiently large to provide its relatively smooth outer surface, and the radius is sufficiently small to retain the closure member on the container prior to removing the closure member with the hook-type opener.

BRIEF DESCRIPTION OF THE DRAWINGS

Illustrative and presently preferred embodiments of the invention are illustrated in the drawings in which.

DETAILED DESCRIPTION OF THE PREFERRED EMBODIMENTS

Figure 1:
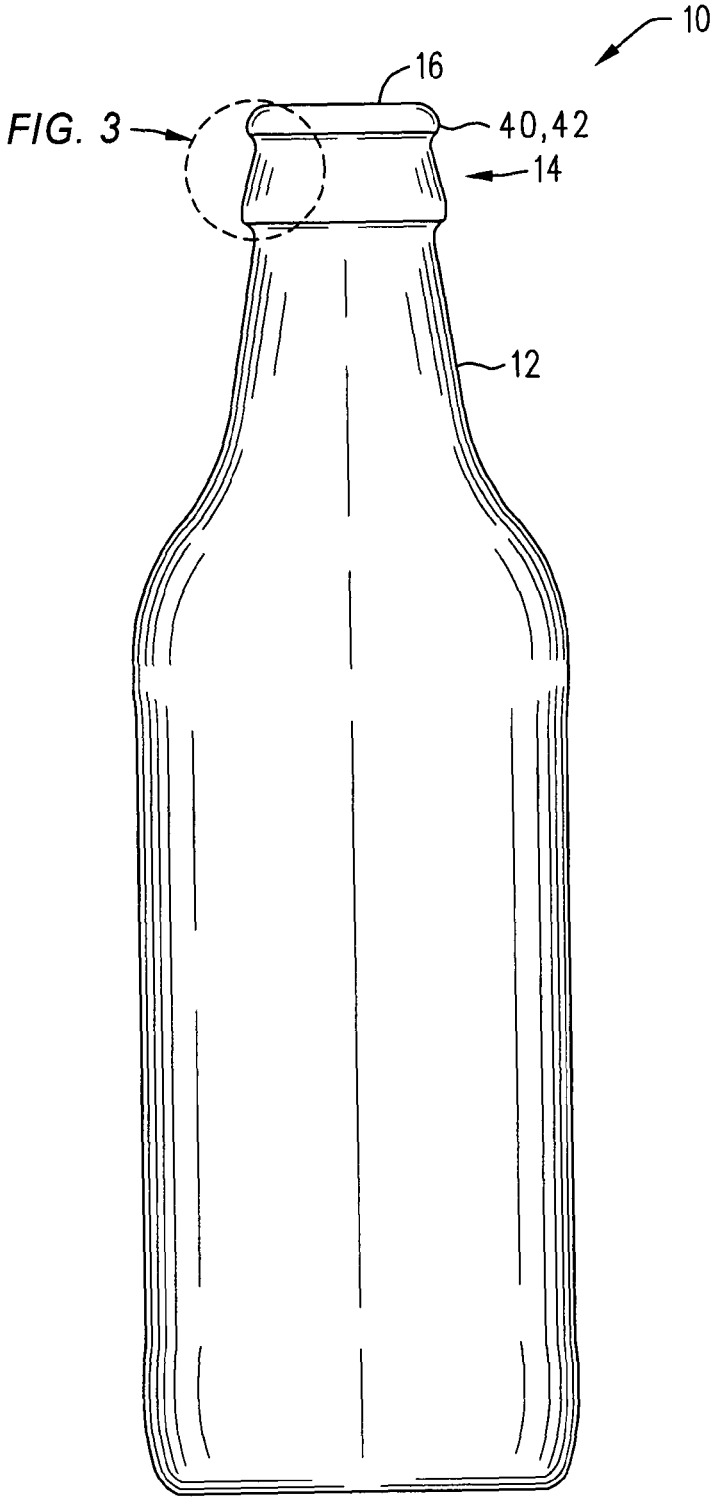
FIG. 1 is a front elevation view of an embodiment of a container here shown as a glass beverage bottle with a breakage-resistant finish ring.
Figure 2:
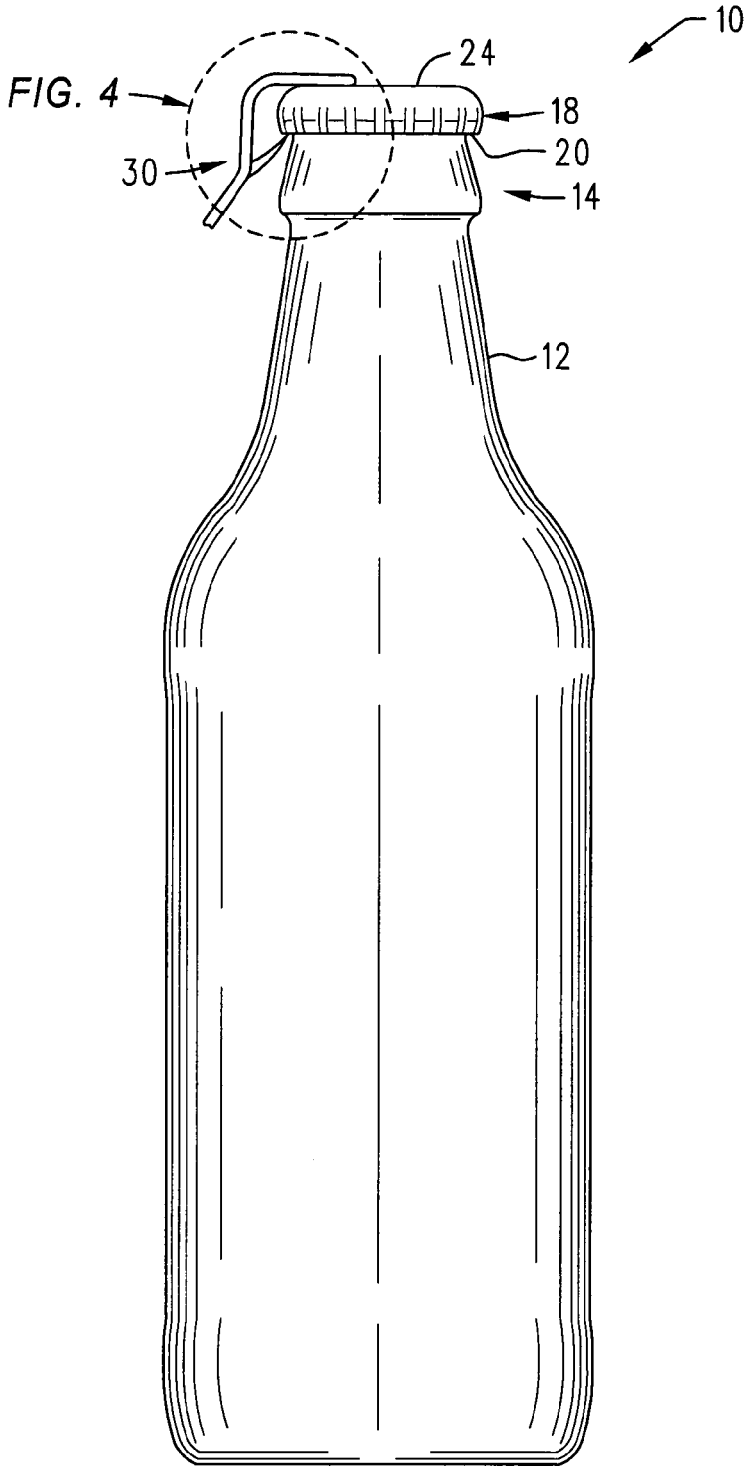
FIG. 2 is a front elevation view of the container of FIG. 1 with a closure member just prior to being removed by a hook-type opener.
Figure 3:
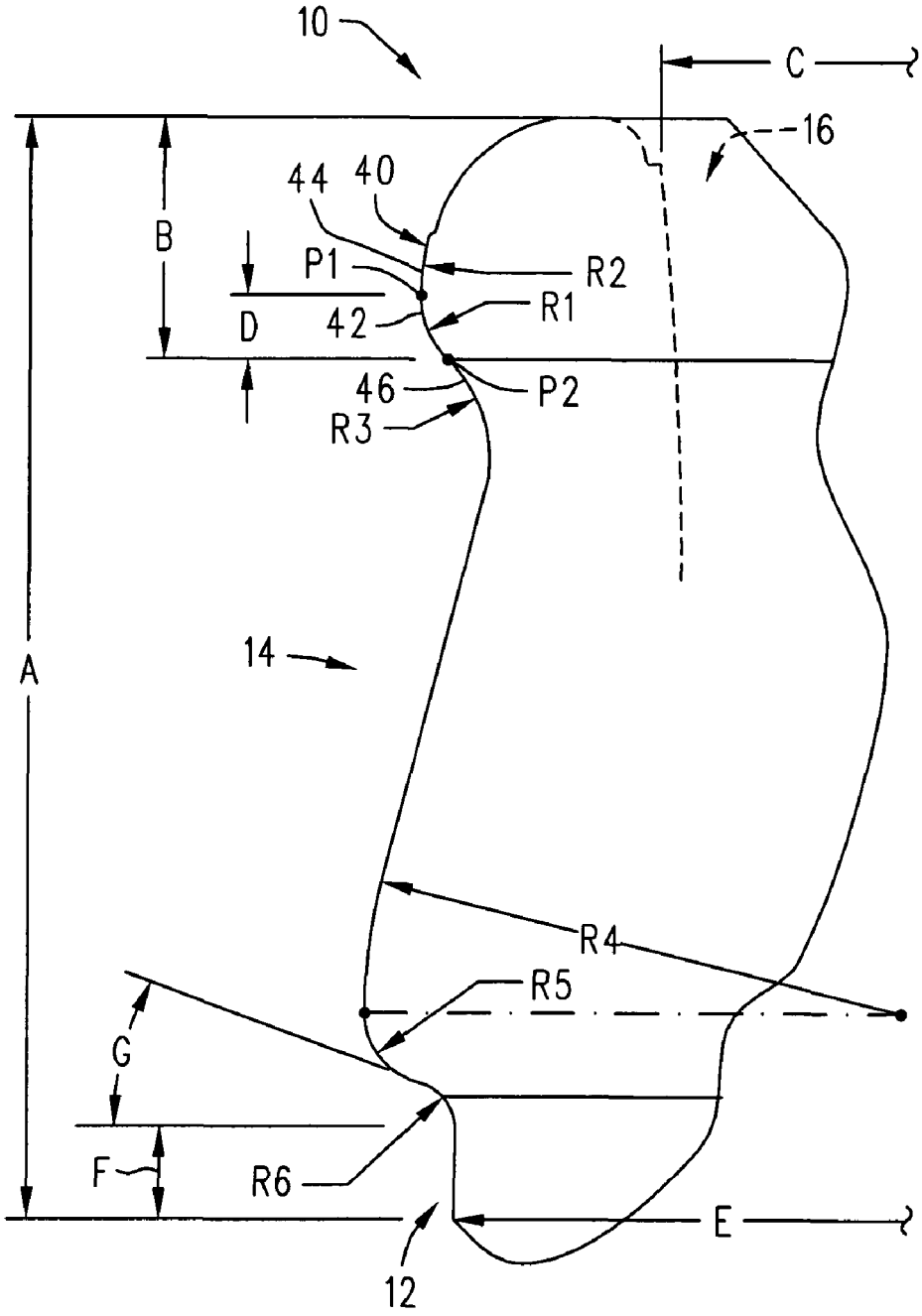
FIG. 3 is an enlarged view of the encircled portion defined in FIG. 1.
Figure 4:
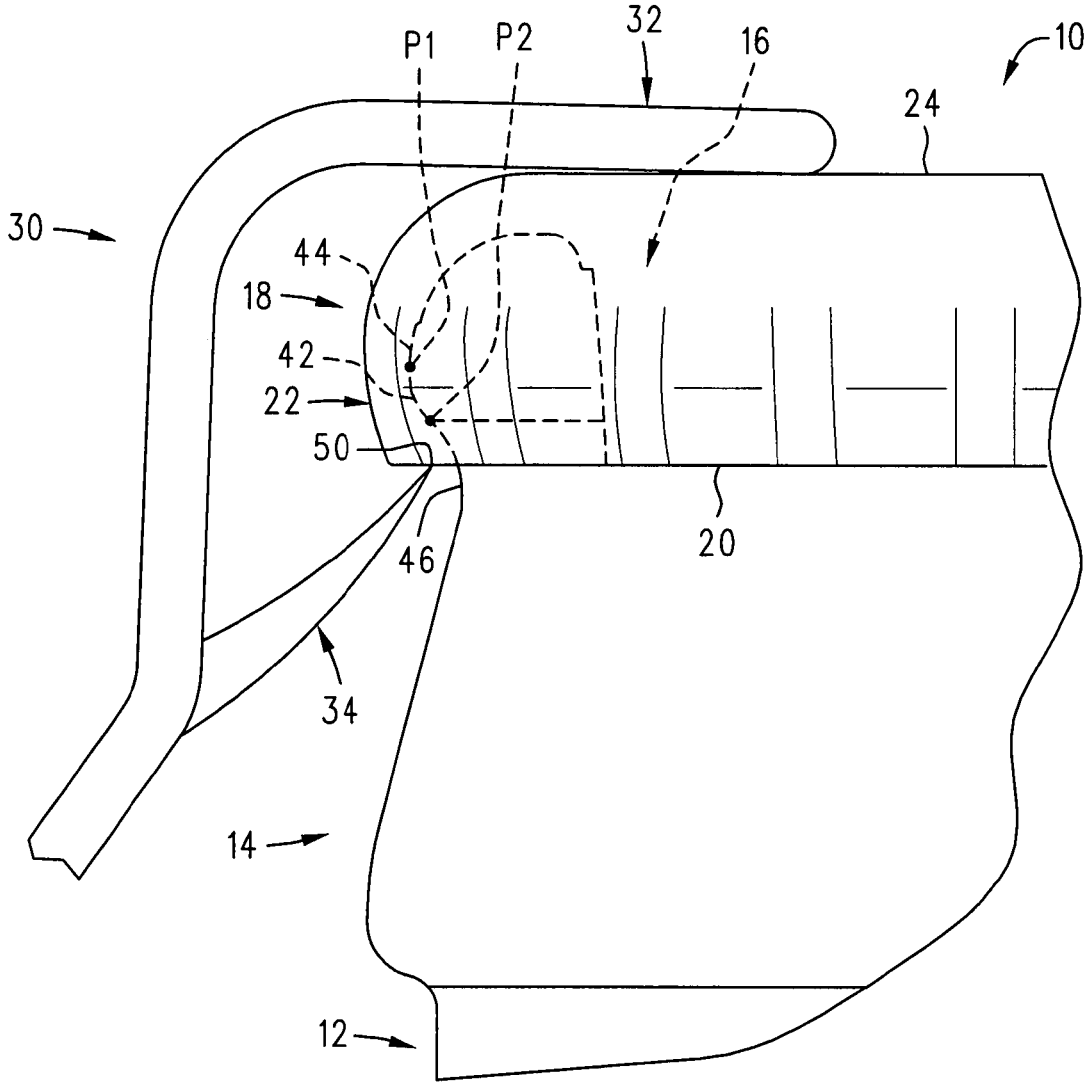
FIG. 4 is an enlarged view of the encircled portion defined in FIG. 2.
Figure 5:
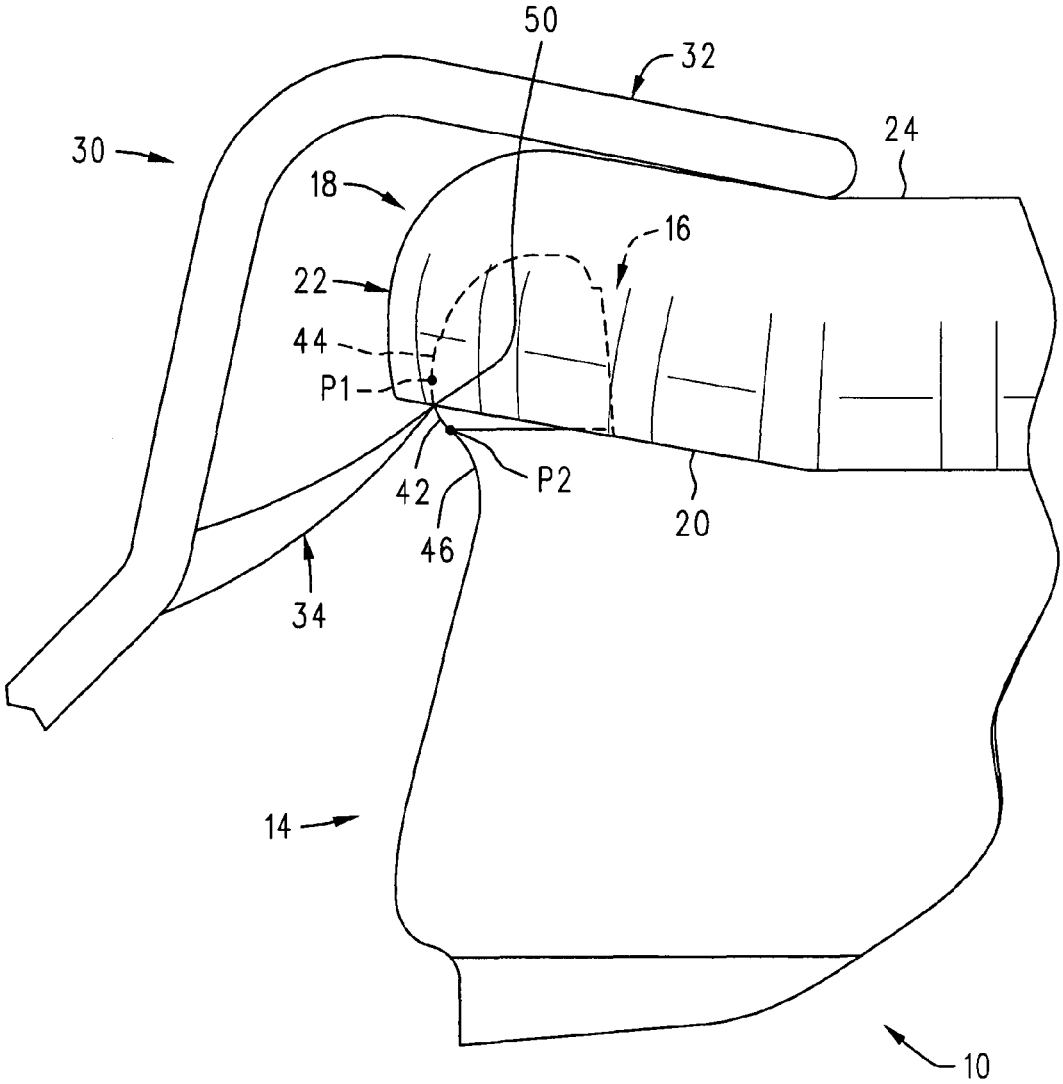
FIG. 5 is an enlarged front elevation view of the breakage-resistant finish ring of FIGS. 1 and 2 and closure member of FIG. 2 partially removed by a hook-type opener.

FIGS. 1–5 illustrate a container 10 such as a glass beverage bottle having a neck 12, a finish ring 40 located above the neck 12 at the top 14 (often referred to as the "finish") of the bottle 10, and an opening 16 in the bottle 10. As shown in FIGS. 2, 4 and 5, the opening 16 is sealable with a closure member 18 such as a crimped cap (also known as a "crown") that is removable with a hook-type opener 30. The closure member 18 may be crimped at and immediately above the peripheral edge 20 thereof in order to seal the closure member 18 on the bottle 10.

As shown in FIGS. 1, 3 and 5, the finish ring 40 is generally a flange that surrounds the opening 16 in the bottle 10. At a lowermost portion of the finish ring 40 is a locking ring 42 which has a convex outer surface. The closure member 18 must be securely crimped or "locked" against the locking ring 42 in order to properly seal the closure member 18 on the bottle 10. As best shown in FIG. 4, when the closure member 18 is sealed on the bottle 10, the crimped portion 22 of the closure member 18 is generally adjacent to and abuts the locking ring 42 and adjacent outer surface portions 44, 46 described in further detail below.

As best shown in FIG. 3, the finish ring 40 may also have an upper convex outer surface portion 44 directly adjacent to and above the locking ring 42. The finish ring 40 may further have a concave outer surface portion 46 directly adjacent to and below the locking ring 42. The locking ring 42 and upper convex outer surface portion 44 intersect at a first circumferential edge represented in FIG. 3 as point "P1, and the locking ring 42 and concave outer surface portion 46 intersect at a second circumferential edge represented in FIG. 3 as point "P2".

In an exemplary embodiment of the invention shown in FIG. 3, the container 10 may have the following approximate dimensions:

A=0.75 inch
B=0.151 inch
C=0.76 inch
D=0.03 inch
E=1 inch
F=0.063 inch
G=20°
R1=0.05 inch
R2=0.156 inch
R3=0.094 inch
R4=0.375 inch
R5=0.047 inch
R6=0.031 inch The dimension "C" shown in FIG. 3 represents the diameter of the bottle opening 16, and the dimension "E" represents the outer diameter of the neck 12 of the bottle 10.

As shown in FIG. 3, the locking ring 42 may have a convex outer surface extending from the first circumferential edge "P1" to the second circumferential edge "P2". The locking ring 42 may have a height "D" and a radius "R1".

The hook-type opener 30 (partially shown in FIGS. 2, 4, and 5) may have a cap-engaging portion 32 (FIGS. 4–5) that engages a portion (e.g., the top surface 24 as shown in the figures) of the closure member 18. The hook-type opener 30 may also have a hook portion 34 that engages the closure member 18 at the peripheral edge 20 thereof. As best shown in FIG. 5, the hook portion 34 passes by and may come into contact with the locking ring 42 as the hook-type opener 30 is rotated and/or lifted to remove the closure member 18. The above-described dimensions, and in particular, the dimensions indicated for the radius "R1" and the corresponding height "D" of the locking ring 42, are sufficiently large to provide a relatively smooth, somewhat flattened surface for the hook portion 34 to pass unimpeded upon removal of the closure member 18 by a hook-type opener 30. More specifically, in the exemplary embodiment shown in FIG. 3, the radius "R1" is preferably at least about 0.045 inch and the corresponding height "D" is preferably at least about 0.027 inch. The hook portion 34 also passes by and may come into contact with the upper convex outer surface portion 44 and the concave outer surface portion 46. Thus, the intersections "P1" and P2" of the locking ring 42 and the outer surface portions 44, 46 are also preferably relatively smooth such that neither the upper convex outer surface portion 44 nor the concave outer surface portion 46, nor the intersections "P1" and "P2", impedes the passage of the hook portion 34 of a hook-type opener 30. More specifically, the locking ring 42 is preferably tangent to the corresponding circumferential edge of the upper convex outer surface portion 44 at the intersection "P1", and the locking ring 42 is preferably tangent to the corresponding circumferential edge concave outer surface portion 46 at the intersection "P2", so that there is a smooth (not a sharp or uneven) transition between the locking ring 42 and these outer surface portions 44, 46. It can be understood that having a sharp or uneven edge or protrusion anywhere along the outer surface of the finish ring 40, and in particular along the outer surface of the locking ring 42, can impede the passage of the hook-type opener 30 in that the hook portion 34 may engage or otherwise disrupt the sharp or uneven edge or protrusion, thereby often resulting in frictive damage to the finish ring 40. Such frictive damage may be in the form of a chip breakage at the finish ring 40 (usually at the locking ring 42 thereof). As the hook-type opener 30 is further rotated/lifted and passes the opening 16 in order to remove the closure member 18, a chip of container material such as glass from a chip breakage can enter the container through the opening 16. The above-described problem may be more prevalent with a hook-type opener 30 that has a hook portion 34 with one or more relatively sharp edges (e.g., 50, FIGS. 4 and 5) thereon which is more likely to engage or otherwise disrupt a sharp or uneven edge on a finish ring 40.

However, it is also to be understood that the locking ring 42 must be sufficiently rounded in order to retain what is known in the art as the "crown blow-off pressure" (i.e., in order to keep the closure member 18 sealed on the bottle 10). More specifically, the radius "R1" and the height "D" of the locking ring 42 must be sufficiently small in order to properly seal the closure member 18 on the locking ring 42. In the exemplary embodiment shown in FIG. 3, the radius "R1" is preferably less than about 0.053 inch and the corresponding height "D" is preferably less than about 0.033 inch. Therefore, as well as retaining the crown blow-off pressure, the above dimensions "D" and "R1" provide a relatively smooth, somewhat flattened locking ring 42 and relatively smooth intersections "P1" and "P2" as described above, thereby providing the breakage-resistant finish ring 40 of the present invention.

While illustrative and presently preferred embodiments of the invention have been described in detail herein, it is to be understood that the inventive concepts may be otherwise variously embodied and employed, and that the appended claims are intended to be construed to include such variations, except as limited by the prior art.

We claim:

1. A container having a damage-resistant finish ring and an opening sealable by a closure member that is removable by a hook-type opener, comprising:

a) a locking ring on said finish ring, said locking ring comprising a convex outer surface having a locking ring radius and a height and extending from a first circumferential edge to a second circumferential edge;

b) an upper convex outer surface portion on said finish ring adjacent to and directly above said locking ring, said upper convex outer surface portion having a radius that is larger than said locking ring radius and a circumferential edge at an intersection of said locking ring and said upper convex outer surface portion; and c) a concave outer surface portion on said finish ring adjacent to and directly below said locking ring, said concave outer surface portion having a radius that is larger than said locking ring radius and a circumferential edge at an intersection of said locking ring and said concave outer surface portion;

d) wherein said locking ring has a relatively smooth outer surface, and wherein said intersection of said locking ring and said upper convex outer surface portion and said intersection of said locking ring and said concave outer surface portion are each relatively smooth, such that said hook-type opener may pass by said locking ring unimpeded upon removal of said closure member by said hook-type opener; and e) wherein said locking ring radius and said height of said locking ring are sufficiently large to provide said relatively smooth outer surface, and said locking ring radius and said height are sufficiently small to retain said closure member on said container prior to removing said closure member with said hook-type opener.

2. The container of claim 1, wherein:

a) said circumferential edge of said upper convex outer surface portion is tangent to said first circumferential edge of said locking ring at said intersection of said locking ring and said upper convex outer surface portion; and b) said circumferential edge of said concave outer surface portion is tangent to said second circumferential edge of said locking ring at said intersection of said locking ring and said concave outer surface portion.

3. The container of claim 1, said locking ring radius being between about 0.045 inch and about 0.053 inch, and said height being between about 0.027 inch and about 0.033 inch.

4. The container of claim 1, said locking ring radius being about 0.05 inch and said height being about 0.03 inch, said radius of said upper convex outer surface portion being about 0.156 inch, and said radius of said concave outer surface Dortion being about 0.094 inch.

* * * * *